United States Patent [19]

van der Wiel et al.

[11] 4,140,619

[45] Feb. 20, 1979

[54] WAX TREATING PROCESS

[75] Inventors: Anton van der Wiel; Bernardus C. Ernsting, both of Amsterdam, Netherlands

[73] Assignee: Shell Oil Company, Houston, Tex.

[21] Appl. No.: 836,330

[22] Filed: Sep. 26, 1977

Related U.S. Application Data

[63] Continuation of Ser. No. 623,520, Oct. 17, 1975, abandoned.

[30] Foreign Application Priority Data

Nov. 28, 1974 [NL] Netherlands ..... 7415510

[51] Int. Cl.[2] ..... C10G 43/02

[52] U.S. Cl. ..... 208/27; 208/3

[58] Field of Search ..... 208/3, 27

[56] References Cited

U.S. PATENT DOCUMENTS

| | | | |
|---|---|---|---|
| 3,183,221 | 5/1965 | Axe et al. | 208/27 |
| 3,425,930 | 2/1969 | Ehrgott et al. | 208/27 |

FOREIGN PATENT DOCUMENTS

| | | | |
|---|---|---|---|
| 975166 | 9/1961 | Fed. Rep. of Germany | 208/27 |

OTHER PUBLICATIONS

Bennett "Commercial Waxes", Second Edition, Pub. Chemical Publishing Co. Inc., New York, N.Y. (1956) pp. 18, 19.

*Primary Examiner*—Herbert Levine

[57] ABSTRACT

The molecular weight of a solid paraffin wax having an oil content of no more than about 2% by weight is increased by contacting the wax at elevated temperature with at least about 5% by weight of an organic peroxide.

8 Claims, No Drawings

WAX TREATING PROCESS

This is a continuation of application Ser. No. 623,520, filed Oct. 17, 1975 and now abandoned.

BACKGROUND OF THE INVENTION

In the refining of distillate and residual lubricating oil fractions by dewaxing, considerable quantities of slack wax are obtained. Depending on the type of lubricating oil fraction from which they originate these slack waxes are termed distillate slack wax or residual slack wax. The distillate slack waxes are further sub-classified, according to increasing molecular weight, as spindle oil slack wax, light machine oil slack wax and medium machine oil slack wax. Slack waxes, regardless of type, contain a considerable quantity of oil that can be removed by de-oiling. By a process of de-oiling distillate paraffin waxes are obtained from the distillate slack waxes and residual paraffin waxes from the residual slack wax.

Solid paraffin wax is used on a large scale for coating paper and cardboard, where the paraffin wax is often used in combination with polymers, and also in the manufacture of candles and polishes. In a number of applications for solid paraffin wax, particularly those mentioned above, two properties of the paraffin wax play an important role in the ease of processing the material. These two properties are (a) the molecular weight, and (b) the setting point of the paraffin wax. In general, it may be said that a solid paraffin wax is better suited to the above applications if the paraffin wax has a higher molecular weight and a higher setting point.

The molecular weight of a solid paraffin wax is largely determined by the lubricating oil fraction from which the paraffin wax originates. Higher molecular weight solid paraffin waxes are typically derived from heavier lubricating oil fractions. Consequently, residual paraffin wax generally has a higher molecular weight than distillate paraffin wax and the molecular weight of distillate paraffin wax increases going from spindle oil paraffin wax to medium machine oil paraffin wax. For the setting point of a solid paraffin wax such general criteria are not available since the setting point greatly depends on the structure of the paraffin wax.

It is broadly known to treat waxes with oxidizing agents to modify the properties of the wax or to convert the wax to products of different character. For example, Ludecke, U.S. Pat. No. 901,718 teaches that oils, fats, waxes and the like can be bleached by contact with peroxides. A similar process of bleaching wax by contact with peroxides employed in combination with an oxidizing gas is disclosed in Swiss Pat. No. 280,480. Merely et al, U.S. Pat. No. 2,626,277, describe a process of producing oxygenated reaction products by treating waxes with peroxides and air. A published German application, OLS No. 2,361,652, discloses the production of lubricating oils by contacting mineral oil fractions with organic peroxides. The resulting lubricants do not require the presence of polymeric VI improvers, probably because of the presence of species of increased molecular weight. None of these references recognize the need for increasing the molecular weight of solid paraffin waxes in order to obtain improved properties, or how to achieve such a result.

With regard to solid paraffin wax obtained from typical lubricating oil fractions, it has been found that the paraffin waxes generally have a sufficiently high setting point, but that, especially for the solid paraffin wax originating from the lighter lubricating oil fractions, a higher molecular weight is desirable. Consequently, there is a need for a process offering the possibility of increasing the molecular weight of a solid paraffin wax by a simple procedure. However, such a process can only be useful if the original high setting point of the paraffin wax is maintained, or perhaps even increased, but in any event, is not decreased by more than about 5° C.

SUMMARY OF THE INVENTION

The present invention contemplates treatment of solid paraffin waxes having an oil content of no more than about 2% by weight to improve the average molecular weight of the wax. More particularly, it has now been found that solid paraffin waxes of increased molecular weight are produced by treatment of solid paraffin wax of lower molecular weight at an elevated temperature with at least about 5% by weight of organic peroxide.

DETAILED DESCRIPTION OF THE INVENTION

In the treatment of wax according to the present invention an increase in molecular weight is attributed to coupling of paraffin wax molecules to each other. When oil is present in the paraffin wax, coupling of oil molecules to oil molecules occurs as a side reaction. While such couplings in principle occur, they have in actual practice been found to play no important role, because of the great difference in concentration between oil and paraffin wax generally existing in the wax to be treated. However, the coupling of oil molecules to paraffin wax molecules is a very undesirable side reaction, in the treatment of a solid paraffin wax containing oil. Although the coupling products contribute to the increased molecular weight of the treated wax, their presence is nevertheless undesirable because they bring about a sharp drop in setting point. In order to insure that the setting point of the paraffin wax shall not decrease by more than 5° C., the oil content of the paraffin wax to be treated must be no more than about 2% by weight. The present invention is applied to solid paraffin waxes of no more than about 2% by weight. Often, the conventional dewaxing of lubricating oil fractions results in the production of slack waxes of too large an oil content.

The de-oiling of slack wax in order to prepare distillate paraffin wax of suitable oil content is effected by melting the slack wax, pouring out the melt in a thin layer and cooling the latter slowly so that the slack wax solidifies again. Slow heating of the solid mass will cause the paraffin waxes with the lowest melting points to melt and to dissolve in the oil that is present as free oil between the paraffin wax crystals. This causes the liquid content of the solid mass to rise. Eventually the liquid content of the solid mass reaches such a level that the liquid can no longer remain adsorbed between the paraffin wax crystals and separates from the solid mass. This sweating, as it is called, of the slack wax is continued until the remaining paraffin wax (distillate paraffin wax) has the desired low oil content. This de-oiling procedure is conventional.

The de-oiling of slack wax for the preparation of residual paraffin wax of suitable oil content is effected by conventional methods in the presence of a solvent. This method is also very suitable for the preparation of distillate paraffin wax. The same solvents can be used for de-oiling as are used for the dewaxing of lubricating fractions. Just as in dewaxing, for de-oiling large-scale use is made in practice of a mixture of ketone and aromatic hydrocarbon solvents, e.g., methyl ethyl ketone and toluene. The de-oiling of slack wax in the presence of a solvent for the preparation of distillate and residual paraffin wax is effected by mixing the slack wax with the solvent, heating the mixture until the waxes have dissolved and then slowly cooling the mixture to the filtration temperature. De-oiling is completed by washing of the solvent from the filtrate and the filter cake.

The peroxide treatment according to the invention is carried out by contacting the paraffin wax for a certain period at elevated temperature with an organic peroxide having the general formula R—O—O—R, in which R independently represents alkyl, aryl or acyl groups of up to 10 carbon atoms, preferably of up to 8 carbon atoms. Examples of suitable organic peroxides are dimethyl peroxide, diethyl peroxide, dipropyl peroxide, ethyl propyl peroxide, tert-butyl tert-amyl peroxide, di-n-butyl peroxide, diacetyl peroxide and dibenzoyl peroxide. Preferred peroxides are those wherein each R is tert-alkyl of 4–10 carbon atoms per molecule, such as di-tert-butyl peroxide, di-tert-amyl peroxide, tert-butyl tert-amyl peroxide and di-tert-octyl peroxide. Di-tert-butyl peroxide is particularly preferred. It is essential that peroxides be used in the process according to the invention since hydroperoxides are unsuitable for the present purpose. The quantity of peroxide that should be used in the process according to the invention is at least about 5% by weight, calculated on paraffin wax. The optimum amount to be employed is dependent, among other factors, on the nature of the paraffin wax chosen as starting material and the increase in molecular weight desired. However, in any case at least about 5% by weight and preferably about 10–30% by weight of the peroxide is utilized. The reaction time and reaction temperature may vary between wide limits, but suitable reaction times are between about 5 minutes and about 10 hours and suitable reaction temperatures are between about 100° C. and about 225° C. The peroxide treatment is preferably carried out so that at least about 90% and preferably at least about 95% of the peroxide has decomposed before the end of the treatment. The reaction time is dependent on the decomposition rate of the peroxide concerned and a shorter reaction time is typically employed if a higher reaction temperature is applied. The peroxide treatment may be carried out in one stage in which the total quantity of peroxide required is added in one portion to the paraffin wax, or it may be carried out in several stages, with part of the total quantity of peroxide required being added in each of two or more stages.

Subsequent to the peroxide treatment the wax of increased molecular weight is separated from peroxide decomposition products, which are typically alcohols corresponding to the peroxide hydrocarbon moieties, by conventional methods such as evaporation, fractional crystallization and the like.

The invention is further illustrated by reference to the following Illustrative Embodiments. In the Illustrative Embodiments several paraffin waxes were treated with 20% by weight based on the wax of di-tert-butyl peroxide for six hours at 150° C. After the peroxide treatment the decomposition products of the peroxide (mainly tert-butyl alcohol) were removed from the reaction product by evaporation. It should be noted that the Illustrative Embodiments are provided for illustration only and are not to be regarded as limiting the appended claims.

ILLUSTRATIVE EMBODIMENT I

A distillate slack wax having an oil content of 15% by weight (% wt) obtained by dewaxing a waxy medium machine oil raffinate was converted by de-oiling into a paraffin wax having an oil content of less than 2% wt and having the following properties:

$\overline{M}_n$ (number average molecular weight) = 491
Setting point = 68° C.
$V_{k210}$ (kinematic viscosity at 210° F.) = 6.57 cSt (centistokes).

This paraffin wax was converted by the peroxide treatment described above to a product having the following properties:

$\overline{M}_n$ = 631
Setting point = 67° C.
$V_{k210}$ = 13.62 cSt.

ILLUSTRATIVE EMBODIMENT II

A normal waxy paraffin having 36 carbon atoms per molecule had the following properties:

$\overline{M}_n$ = 507
Setting point = 76° C.
$V_{k210}$ = 6.48 cSt.

This paraffin was converted by the peroxide treatment disclosed above to a product having the following properties:

$\overline{M}_n$ = 685
Setting point = 73.4° C.
$V_{k210}$ = 14.34 cSt.

ILLUSTRATIVE EMBODIMENT III

A residual slack wax having an oil content of 30% wt obtained by dewaxing a waxy bright stock raffinate was converted by de-oiling into a paraffin wax having an oil content of less than 2% wt and having the following properties:

$\overline{M}_n$ = 694
Setting point = 83° C.
$V_{k210}$ = 14.56 cSt.

This paraffin wax was converted by the peroxide treatment disclosed above to a product having the following properties:

$\overline{M}_n$ = 1044
Setting point = 81.5° C.
$V_{k210}$ = 95.18 cSt.

We claim:

1. A process for increasing the molecular weight of a paraffin wax without decreasing the setting point of the wax more than 5° C. by first contacting a solid paraffin wax having an oil content of no more than about 2% by weight at an elevated temperature with at least 5% by weight of an organic peroxide to produce a crude reaction mixture comprising a paraffin wax of increased molecular weight and peroxide decomposition products and subsequently separating the wax of increased molecular weight from the peroxide decomposition products by evaporation or fractional crystallization.

2. The process of claim 1 wherein said wax is contacted at a temperature from about 100° C. to about 225° C. with an organic peroxide of the formula R—O—O—R wherein R independently is alkyl, acyl or aryl of up to 10 carbon atoms.

3. The process of claim 2 wherein each R is tert-alkyl.

4. The process of claim 3 wherein each R is tert-butyl.

5. A process for increasing the molecular weight of a paraffin wax without decreasing the setting point of the wax more than 5° C. by first contacting a solid paraffin wax having an oil content of no more than about 2% by weight at an elevated temperature with between 10% and 30% by weight of an organic peroxide to produce a crude reaction mixture comprising a paraffin wax of increased molecular weight and peroxide decomposition products and subsequently separating the wax of increased molecular weight from the peroxide decomposition products by evaporation or fractional crystallization.

6. The process of claim 5 wherein said wax is contacted at a temperature from about 100° C. to about 225° C. with an organic peroxide of the formula R—O—O—R wherein R independently is alkyl, acyl or aryl of up to 10 carbon atoms.

7. The process of claim 6 wherein each R is tert-alkyl.

8. The process of claim 7 wherein each R is tert-butyl.

* * * * *